US010279946B2

(12) United States Patent
Lin

(10) Patent No.: US 10,279,946 B2
(45) Date of Patent: May 7, 2019

(54) LABEL DISPENSING MACHINE

(71) Applicant: COSMO MACHINERY CO., LTD., New Taipei (TW)

(72) Inventor: Chun Liang Lin, New Taipei (TW)

(73) Assignee: COSMO MACHINERY CO., LTD., New Taipei (TW)

( * ) Notice: Subject to any disclaimer, the term of this patent is extended or adjusted under 35 U.S.C. 154(b) by 56 days.

(21) Appl. No.: 15/706,667

(22) Filed: Sep. 16, 2017

(65) Prior Publication Data

US 2018/0009561 A1 Jan. 11, 2018

Related U.S. Application Data

(63) Continuation-in-part of application No. 15/202,668, filed on Jul. 6, 2016, now abandoned.

(51) Int. Cl.

| | |
|---|---|
| ***B65C 9/18*** | (2006.01) |
| ***B65C 9/00*** | (2006.01) |
| ***B65H 5/28*** | (2006.01) |
| ***B65C 11/00*** | (2006.01) |
| ***B65C 9/42*** | (2006.01) |
| ***B26F 1/20*** | (2006.01) |
| ***B65H 35/08*** | (2006.01) |
| *B26D 1/08* | (2006.01) |

(52) U.S. Cl.

CPC ..... *B65C 9/1865* (2013.01); *B26F 1/20* (2013.01); *B65C 9/00* (2013.01); *B65C 9/42* (2013.01); *B65C 11/006* (2013.01); *B65H 5/28* (2013.01); *B65H 35/08* (2013.01); *B26D 1/085* (2013.01); *B65H 2301/41* (2013.01)

(58) Field of Classification Search

CPC ..... B65C 9/1865; B65C 9/00; B65C 3/14; B65H 35/08; B65H 5/28; B65H 2301/41; B26F 1/20; Y10S 156/908

USPC ..... 242/475.7, 615

See application file for complete search history.

(56) References Cited

U.S. PATENT DOCUMENTS

| | | | | |
|---|---|---|---|---|
| 4,253,902 | A * | 3/1981 | Yada | B65C 9/188 156/361 |
| 4,265,695 | A * | 5/1981 | Hurley | B65C 3/14 156/285 |
| 5,702,559 | A * | 12/1997 | Bright | B41J 3/32 156/212 |
| 2006/0010836 | A1* | 1/2006 | Kahlisch | B65C 3/14 53/415 |
| 2010/0186871 | A1* | 7/2010 | Skaggs | B65C 3/14 156/60 |

* cited by examiner

*Primary Examiner* — Mark A Osele
*Assistant Examiner* — Christopher C Caillouet
(74) *Attorney, Agent, or Firm* — Chun-Ming Shih

(57) ABSTRACT

A label dispensing machine includes a label curving cover, and arched label output mechanism for outputting a continuous series of label strip to an inner side of the label curving cover where the lead end of the continuous series of label strip is curved by the label curving cover into an integral arch-shaped label. The label dispensing machine is disposed at one side of a film roll/bags-on-a-roll on a reel so that the arch-shaped label can be cut off and adhered to a cut-off lead end of the film roll/bags-on-a-roll and partially exposed to the outside of the tear line of the film roll/bags-on-a-roll easily for allowing the user to quickly find and lift the cut-off lead end of the film roll/bags-on-a-roll.

10 Claims, 11 Drawing Sheets

LABEL DISPENSING MACHINE

BACKGROUND OF THE INVENTION

1. Field of the Invention

The present invention relates to label dispensing machine and more particularly, to such a label dispensing machine practical for use in a film roll/bags-on-a-roll making machine for curving a label and adhering the arch-shaped label to a tear line of a film roll/bags-on-a-roll made by the film roll/bags-on-a-roll making machine.

2. Description of the Related Art

Commercial plastic wraps are commonly provided in rolls and packed in individual boxes. Many film roll/bags-on-a-roll making machines are known for processing a plastic wrap into rolls, facilitating sales and use.

However, because the plastic film or paper of a film roll/bags-on-a-roll/paper roll is a transparent, soft and thin film, a user cannot easily find out the cut lead end of the plastic film or paper for application.

U.S. Pat. No. 9,604,809 "film roll/bags-on-a-roll making machine" (equivalent to China Patent No. CN204588215U; Taiwan Patent No. M504084), which includes a feeding unit for transferring a film/sheet of bags, a reel displacement unit for cycling a reel through a reel let-off position, a reel-supplying position, a film-rolling position and a film-cutting position for enabling the reel to roll up the film/sheet of bags into a film roll/bags-on-a-roll, a cutting device for cutting off the feeding film/sheet of bags from the film roll/bags-on-a-roll at the reel that is cycled to the film-cutting position, and a control unit for controlling the operation of the feeding unit, the reel displacement unit and the cutting device. This design of film roll/bags-on-a-roll making machine is functional, however, it does not provide the cut lead end of the film roll/bags-on-a-roll with a label for allowing the user to visually and rapidly find out the cut lead end of the film roll/bags-on-a-roll.

Therefore, it is desirable to provide a measure for allowing the user to rapidly and visually find out the cut lead end of a film roll/bags-on-a-roll for convenient application.

SUMMARY OF THE INVENTION

The present invention has been accomplished under the circumstances in view. It is therefore one object of the present invention to provide a label dispensing machine, which efficiently attaches an arch-shaped label onto a cut-off lead end of a film roll/bags-on-a-roll on a reel of a film roll/bags-on-a-roll making machine so that the user can easily and quickly find and lift the cut-off lead end of the film roll/bags-on-a-roll. The film roll/bags-on-a-roll can be continuous series of plastic wraps, a plastic film, a continuous series of plastic bags, or a paper sheet.

To achieve this and other objects of the present invention, a label dispensing machine comprises a label curving cover defining an arched inner wall, a label curving cover driver coupled with the label curving cover and operable to bias the label curving cover, an arched label output mechanism disposed at one side relative to the label curving cover, and a control unit. The arched label output mechanism comprises a mount, a cut-off device, a guide unit, an active wheel, a passive wheel, an arched label feeding driver, a feeding wheel, a continuous series of label strip and a movable device. The cut-off device is mounted at a top side of the mount. The guide unit is mounted at the mount below the cut-off device. The active wheel and the passive wheel are mounted at the mount below the guide unit, and disposed in contact with each other. The arched label feeding driver is mounted at the mount, and adapted for rotating the active wheel. The feeding wheel is rotatably mounted at an opposing bottom side of the mount. The continuous series of label strip is wound round the feeding wheel, having a lead end thereof inserted in between the active wheel and the passive wheel and guided by the guide unit over one side of the cut-off device. The movable device is connected with the mount and operable to move the mount. The control unit is electrically coupled with the label curving cover driver, the cut-off device, the arched label feeding driver and the movable device for controlling the operation of the label curving cover driver, the cut-off device, the arched label feeding driver and the movable device.

Further, the control unit controls the label curving cover driver to move the label curving cover, causing the label curving cover to cover the film roll/bags-on-a-roll on the reel with a gap left between the arched inner wall of the label curving cover and the film roll/bags-on-a-roll. The movable device is controllable by the control unit to move the mount, the cut-off device, guide unit, active wheel, passive wheel, arched label feeding driver and feeding wheel of the arched label output mechanism toward the label curving cover, keeping the cut-off device in proximity to a bottom side of the label curving cover. When a predetermined length of the continuous series of label strip is fed out, the free end of the continuous series of label strip reaches the arched inner wall of the label curving cover and curved by the arched inner wall to form an integral arch-shape label. At this time, the arched label feeding driver is stopped, and the cut-off device cuts off the arch-shaped label from the continuous series of label strip, enabling the cut-off arch-shaped label to be adhered to a tear line of the film roll/bags-on-a-roll on the reel.

In application, the label dispensing machine is installed in a film roll/bags-on-a-roll making machine. The film roll/bags-on-a-roll making machine comprises a reel displacement unit, a cut-off mechanism and a smoothening unit. The reel displacement unit comprises a reel rolling up a film roll/bags-on-a-roll, and a reel holding device configured to hold the reel and moving the reel properly through a reel let-off position, a reel-supplying position, a film-rolling position and a film-cutting position to dispense the film roll/bags-on-a-roll. The free end of the film roll/bags-on-a-roll is pulled out of the reel when the reel is moved from the film-rolling position to the film-cutting position, and then a predetermined length of the free end of the film roll/bags-on-a-roll is pulled out of the reel for allowing the film roll/bags-on-a-roll to be cut off when reached the film-cutting position. The label dispensing machine and the label curving cover are disposed at one side relative to the film roll/bags-on-a-roll on the reel of the reel displacement unit in the film-cutting position. The control unit (computer, microprocessor, control IC, etc.) is electrically coupled with the film roll/bags-on-a-roll making machine for controlling the operation of the film roll/bags-on-a-roll making machine. The control unit controls the smoothening unit of the film roll/bags-on-a-roll making machine to smoothen the cut-off lead end of the film roll/bags-on-a-roll and the arch-shaped label that is wrapped in the film roll/bags-on-a-roll. Subject to the material property of the film roll/bags-on-a-roll, the arch-shaped label is wrapped in the film roll/bags-on-a-roll, leaving a short end portion of the arch-shaped label outside the film roll/bags-on-a-roll. This short end portion of the arch-shaped label can easily found by a user and the user can then easily lift the cut-off lead end of the film roll/bags-on-a-roll.

Thus, the invention achieves the effect of efficiently attaching the arch-shaped label onto the cut-off lead end of the film roll/bags-on-a-roll on the reel so that the user can easily and quickly find and lift the cut-off lead end of the film roll/bags-on-a-roll, eliminating the problem of being difficult to find and to lift the cut-off lead end of the thin and flexible film roll/bags-on-a-roll.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
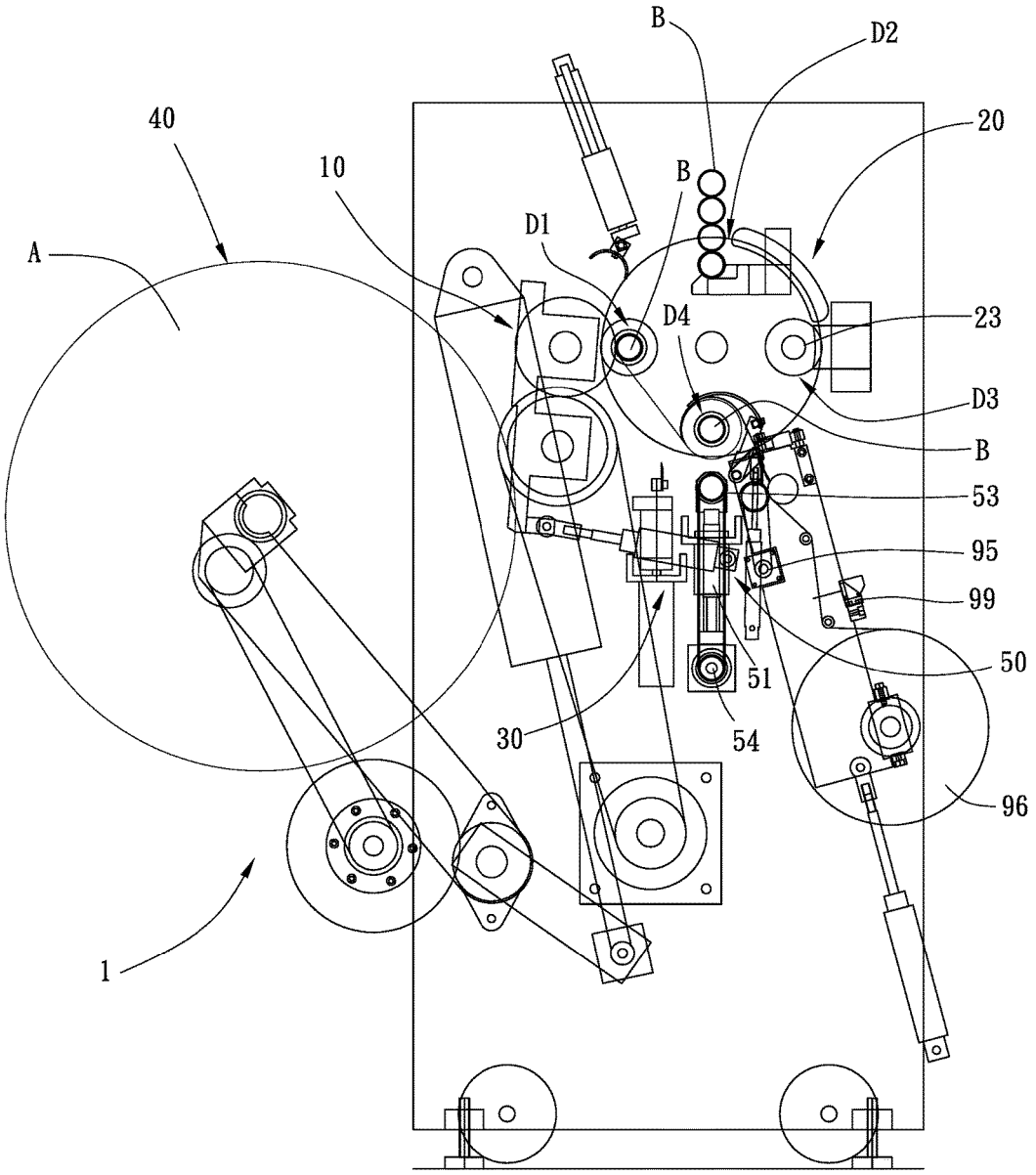
FIG. 1 is schematic side view illustrating a label dispensing machine used in a film roll/bags-on-a-roll making machine in accordance with the present invention.
Figure 2:
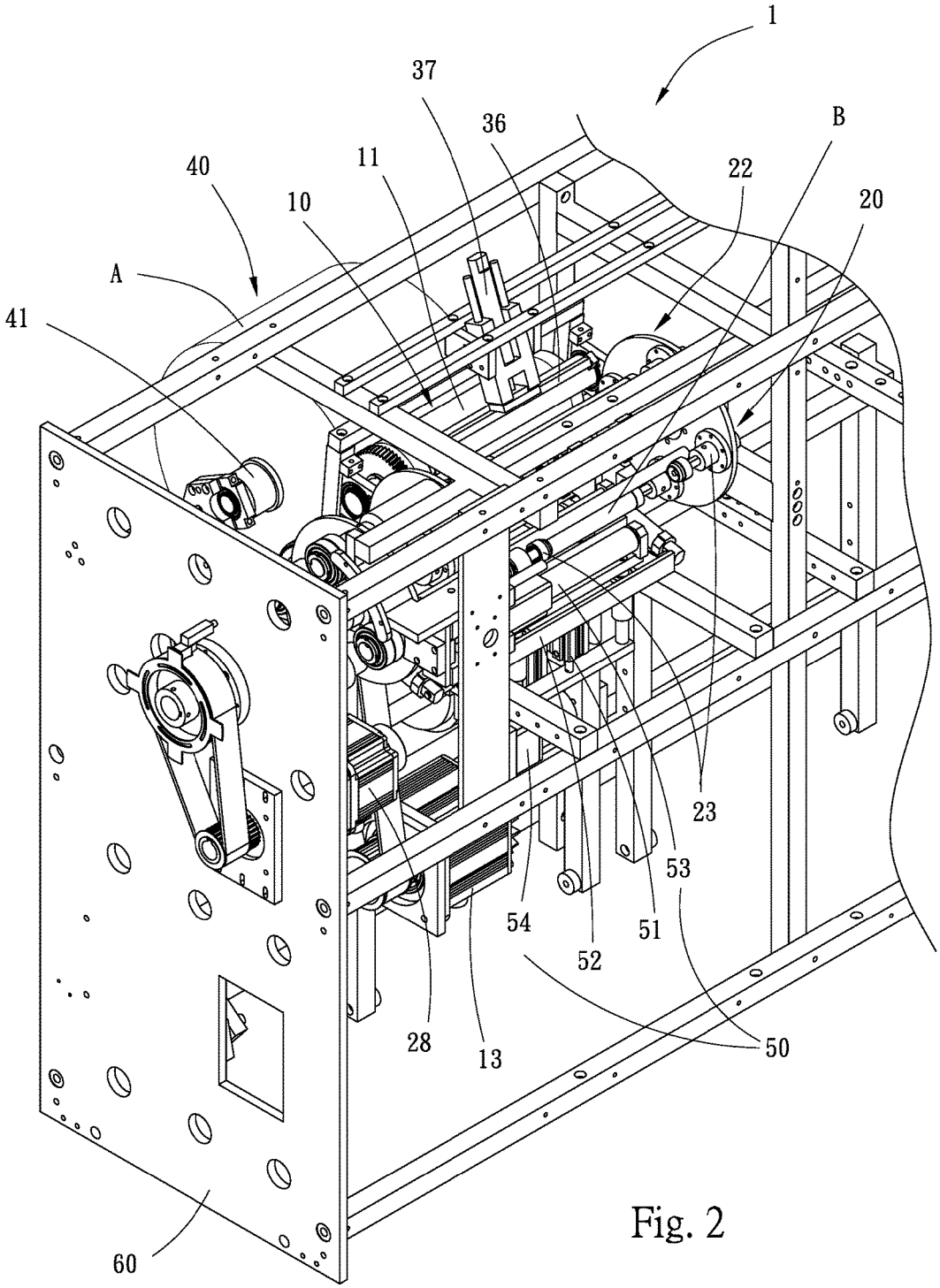
FIG. 2 is an oblique top elevational partial view of the film roll/bags-on-a-roll making machine.
Figure 3:
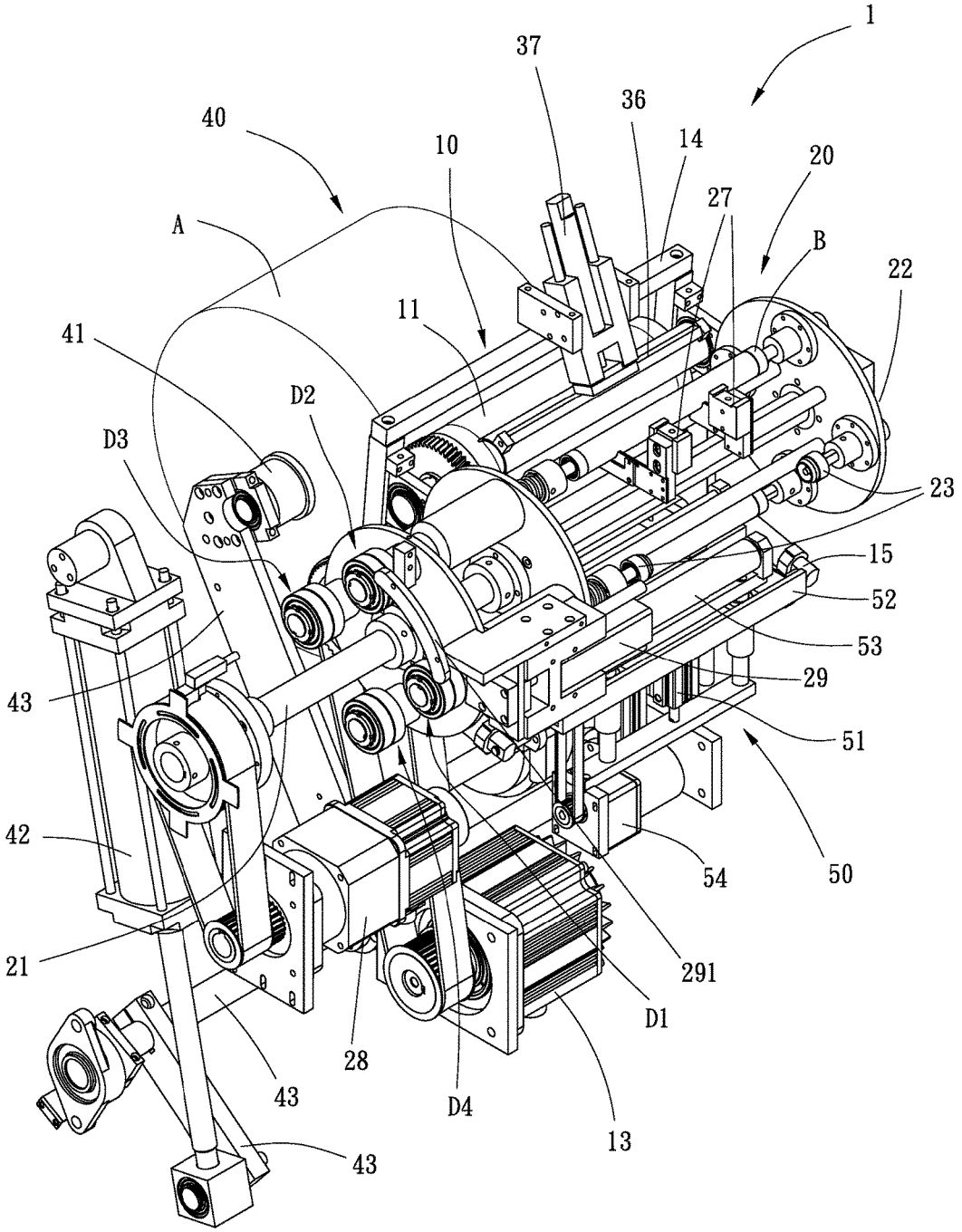
FIG. 3 is another oblique top elevational partial view of the film roll/bags-on-a-roll making machine.

Referring to FIGS. 1-3, a label dispensing machine in accordance with the present invention is shown attached to one side of a film roll/bags-on-a-roll making machine 1 (see FIGS. 1 and 2). The label dispensing machine is mounted at one side of the film roll/bags-on-a-roll making machine 1 The film roll/bags-on-a-roll making machine 1 comprises a feeding unit 10, a reel displacement unit 20, a cut-off mechanism 30, a material holding unit 40, and a smoothening unit 50. In this embodiment, the label dispensing machine 8 is disposed adjacent to the film-cutting position D4 of the reel displacement unit 20 between the film roll/bags-on-a-roll A and the smoothening unit 50. With respective to the structural details of the film roll/bags-on-a-roll making machine 1, please refer to U.S. Pat. No. 9,604,809, entitled "film roll/bags-on-a-roll making machine" (equivalent to China Patent No. CN204588215U; Taiwan Patent No. M504084).

Figure 4:
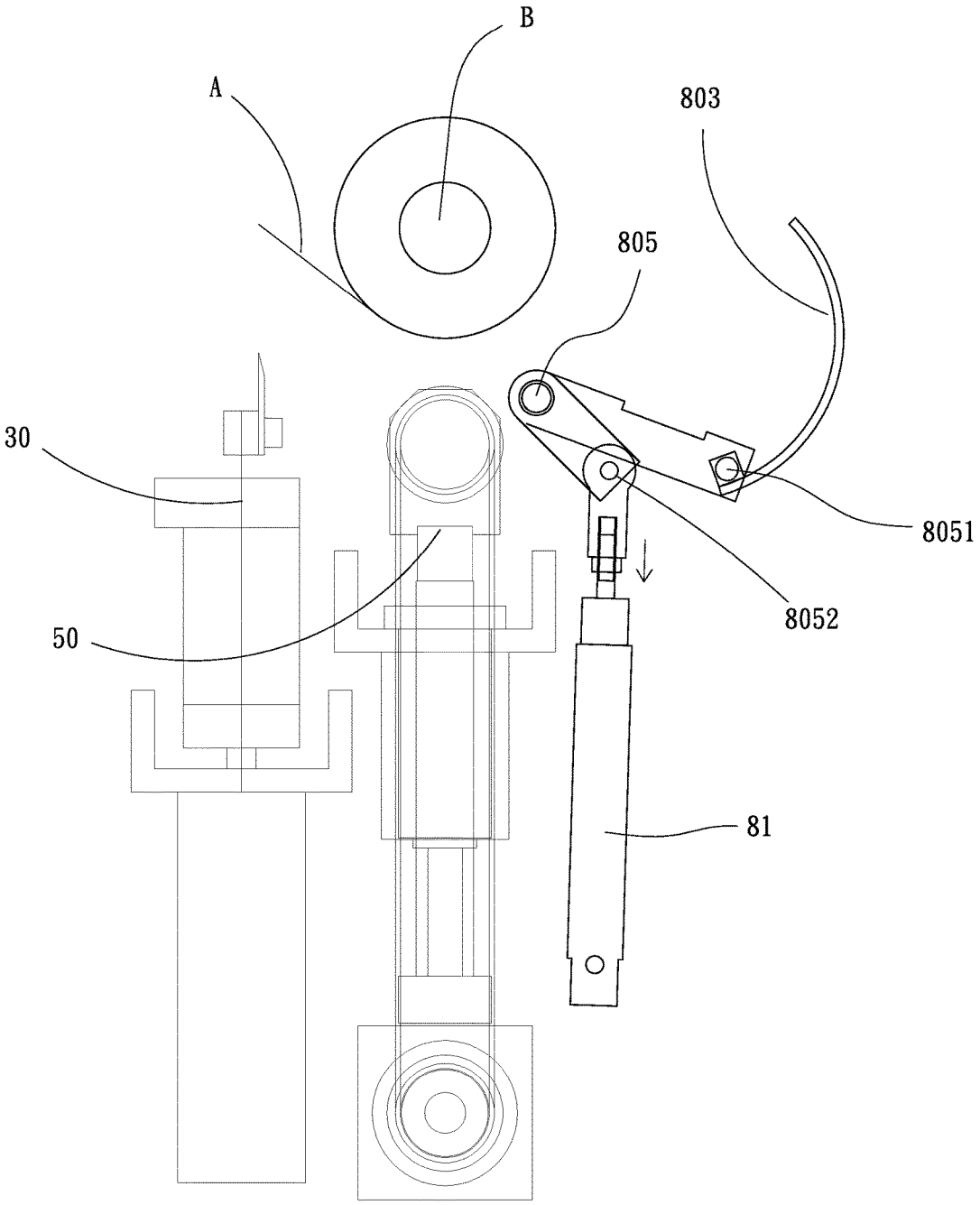
FIG. 4 is a schematic side view of the invention, illustrating the label curving cover of the label dispensing machine disposed at one side relative to the reel.
Figure 5:
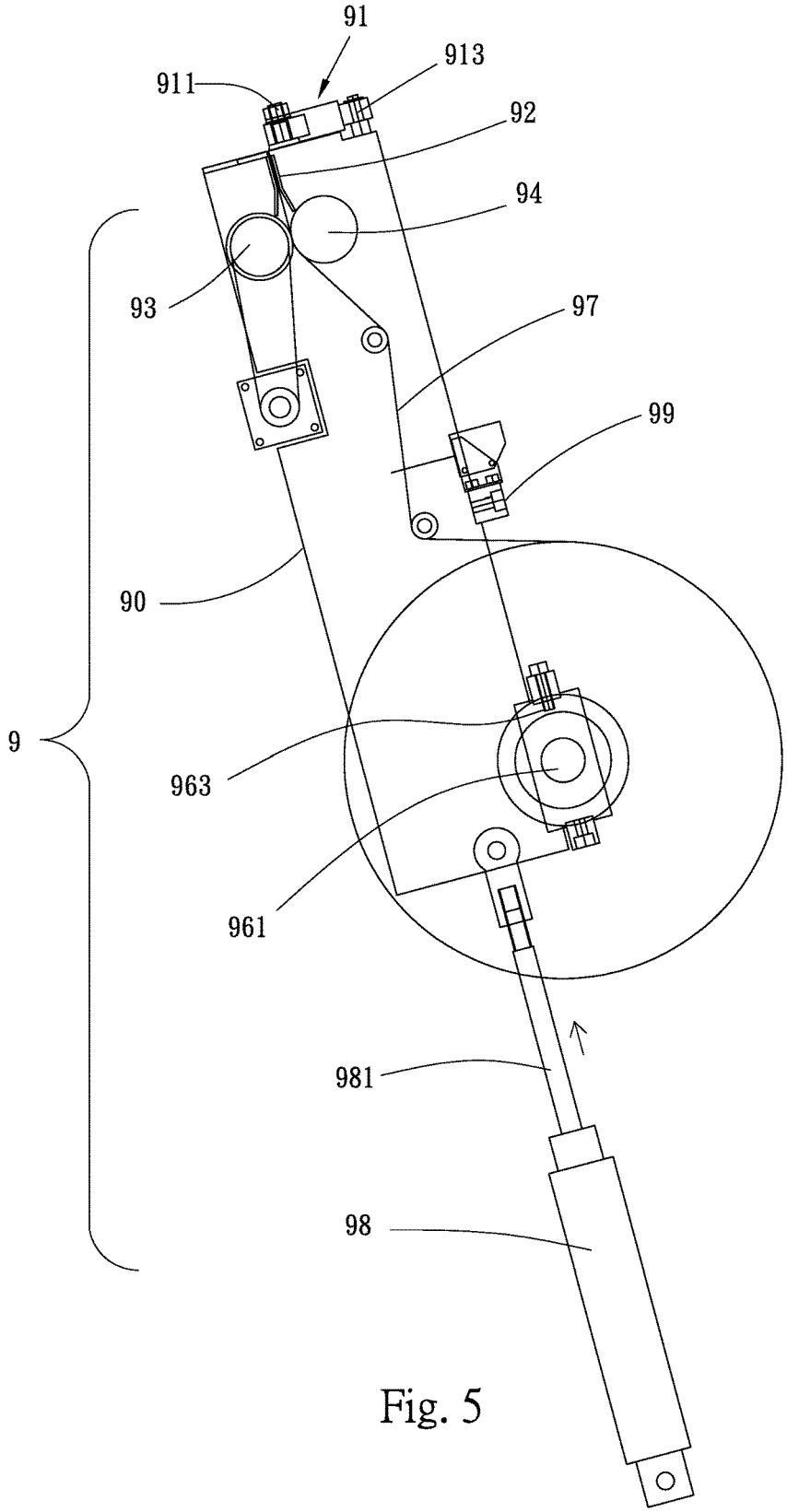
FIG. 5 is a side view of the arched label output mechanism of the label dispensing machine.
Figure 6:
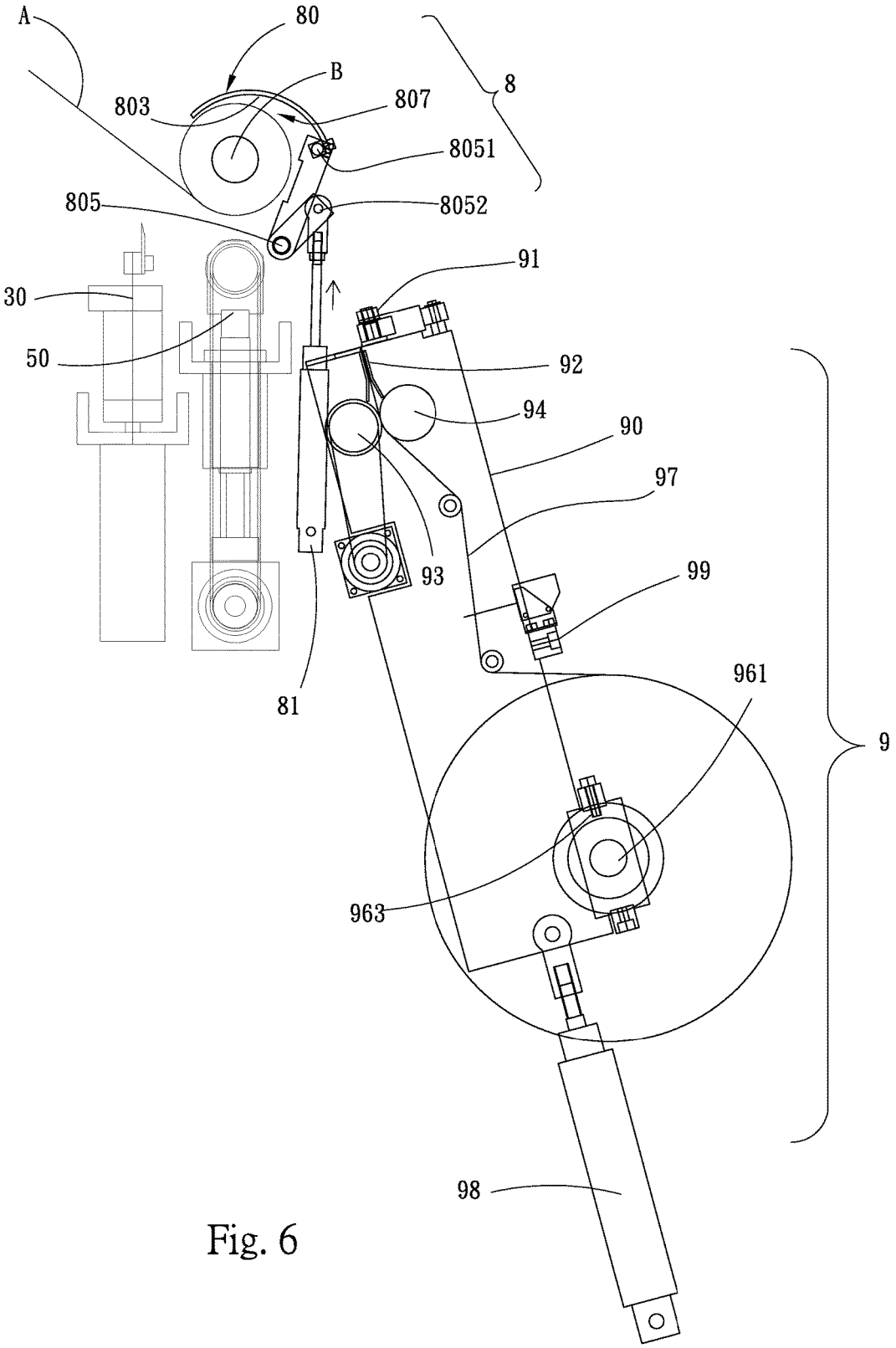
FIG. 6 is a schematic side view of the invention, illustrating the arched label output mechanism of the label dispensing machine disposed at one side relative to the reel.

Referring to FIGS. 4-6 and FIG. 1 again, the label dispensing machine 8 comprises a label curving cover 80 defining an arched inner wall 803, a label curving cover driver 81 connected with the label curving cover 80 and adapted for moving the label curving cover 80, and an arched label output mechanism 9. The arched label output mechanism 9 is disposed at one side relative to the label curving cover 80, comprising a mount 90, a cut-off device 91, a guide unit 92, an active wheel 93, a passive wheel 94, an arched label feeding driver 95, a feeding wheel 96, a continuous series of label strip 97, and a movable device 98. The cut-off device 91 is disposed above the mount 90. The guide unit 92 is mounted on the mount 90 below the cut-off device 91. The active wheel 93 and the passive wheel 94 are coupled to the mount 90 below the guide unit 92 and peripherally disposed in contact with each other. The arched label feeding driver 95 is mounted on the mount 90 and adapted for rotating the active wheel 93. The feeding wheel 96 is rotatably mounted on an opposing bottom side of the mount 90. The continuous series of label strip 97 is wound round the feeding wheel 96 and inserted in between the active wheel 93 and the passive wheel 94 and the guide unit 92 to one side of the cut-off device 91. The movable device 98 has one end thereof connected to the mount 90, and is adapted for moving the mount 90.

Further, a control unit is electrically coupled with the label curving cover driver 81, the cut-off device 91, the arched label feeding driver 95 and the movable device 98. The label curving cover driver 81 is operable to move the label curving cover 80 to one side of a film roll/bags-on-a-roll A on a reel B (see FIG. 4). The movable device 98 is operable to move the mount 90, cut-off device 91, guide unit 92, active wheel 93, passive wheel 94, arched label feeding driver 95 and feeding wheel 96 of the arched label output mechanism 9 toward the label curving cover 80 to the position where the cut-off device 91 is disposed in proximity to a bottom side of the label curving cover 80. When the continuous series of label strip 97 is let off for a predetermined length, the free end of the continuous series of label strip 97 is moved into the arched inner wall 803 of the label curving cover 80 and forced by arched inner wall 803 to curve smoothly. Thereafter, the arched label feeding driver 95 is stopped, allowing the cut-off device 91 to cut off an arch-shaped label 971 from the continuous series of label strip 97 (see FIG. 10). The arch-shaped label 971 can be adhered to a tear line A1 of the film roll/bags-on-a-roll A on the reel B (see FIG. 11).

Figure 7:
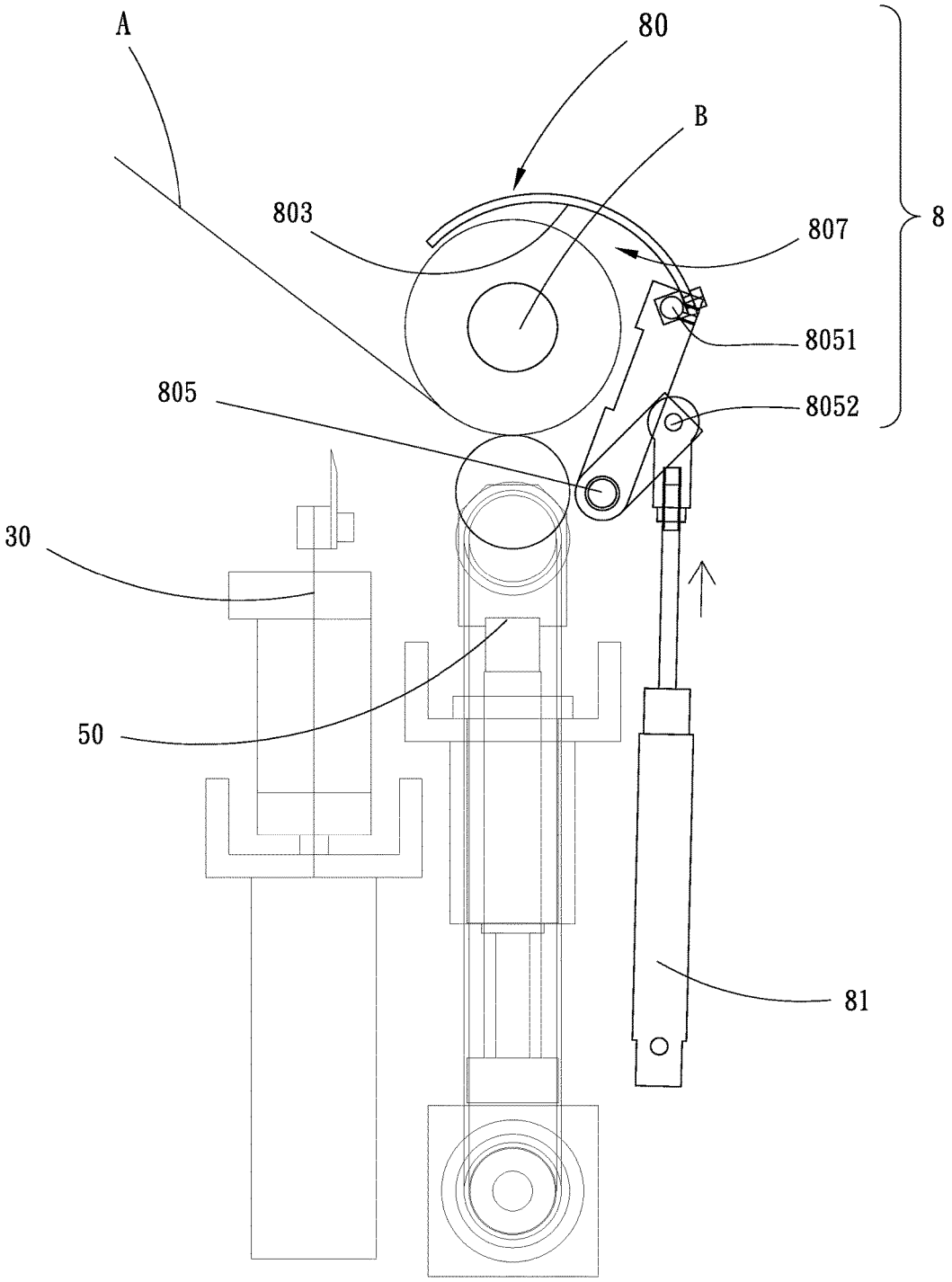
FIG. 7 is a schematic side view of the invention, illustrating the label curving cover of the label dispensing machine covered over the reel.

Referring to FIG. 7, the control unit (not shown) controls the label curving cover driver 81 to move the label curving cover 80, causing the label curving cover 80 to cover the film roll/bags-on-a-roll A of the reel B. At this time, a gap 807 is left between the arched inner wall 803 of the label curving cover 80 and the film roll/bags-on-a-roll A.

Figure 8:
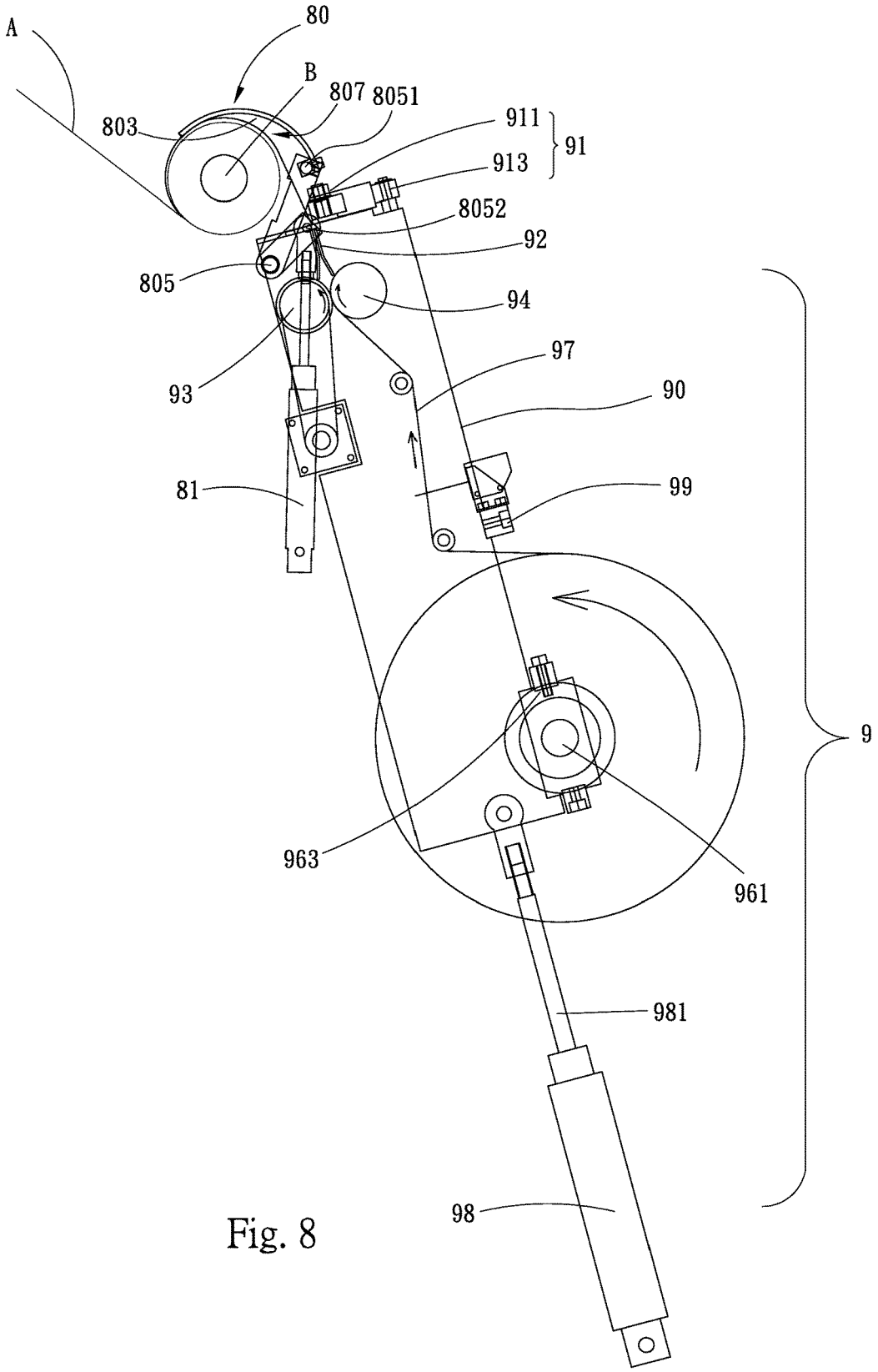
FIG. 8 is a schematic drawing of the present invention, illustrating the label dispensing machine disposed at one side relative to the reel and operated.

Referring to FIG. 8, the movable device 98 is operable to move the mount 90, cut-off device 91, guide unit 92, active wheel 93, passive wheel 94, arched label feeding driver 95 and feeding wheel 96 of the arched label output mechanism 9 toward the label curving cover 80 to keep the cut-off device 91 in proximity to the bottom side of the label curving cover 80. Thereafter, the control unit controls the arched label feeding driver 95 to rotate the active wheel 93 and the abutted passive wheel 94, causing the continuous series of label strip 97 to be delivered between the active wheel 93 and the passive wheel 94 and guided by the guide unit 92 to one side of the cut-off device 91 with the free end of the continuous series of label strip 97 reaching the gap 807 between the arched inner wall 803 of the label curving cover 80 and the film roll/bags-on-a-roll A, and thus, the free end of the continuous series of label strip 97 is guided by the arched inner wall 803 in the gap 807 to mate with the arched surface of the film roll/bags-on-a-roll A of the reel B. At this time, the free end of the continuous series of label strip 97 is partially wrapped by the film roll/bags-on-a-roll A, and the arched label feeding driver 95 is then stopped. Thereafter, the control unit controls the cut-off device 91 to cut off the arch-shaped label 971 (a predetermined length of the free end) of the continuous series of label strip 97 (see FIG. 9), enabling the arch-shaped label 971 to be bonded to one tear line of the film roll/bags-on-a-roll A with a lead end thereof disposed outside the tear line.

In the embodiment shown in FIGS. 1-3 again, the label dispensing machine is mounted to a film roll/bags-on-a-roll making machine 1. With respect to the structural details of this film roll/bags-on-a-roll making machine 1, please refer to U.S. Pat. No. 9,604,809 "film roll/bags-on-a-roll making machine" (equivalent to China Patent No. CN204588215U; Taiwan Patent No. M504084). The film roll/bags-on-a-roll making machine 1 comprises a reel replacement unit 20, a cut-off mechanism 30, and a smoothening unit 50. The reel displacement unit 20 comprises a reel B that rolls up a film roll/bags-on-a-roll A, and a reel holding device 23. The reel holding device 23 is configured to hold the reel B and moving the reel B through a series of step positions D1~D4 (D1 is the reel let-off position; the step position D2 is the reel-supplying position; the step position D3 is the film-rolling position; the step position D4 is the film-cutting position) to dispense the film roll/bags-on-a-roll. When the reel B is moved from the film-rolling position D3 to the film-cutting position D4, the free end of the film roll/bags-on-a-roll A is pulled out of the reel B. When reached the film-cutting position D4, it means that a certain length of the free end of the film roll/bags-on-a-roll A has been pulled out of the reel B, allowing the film roll/bags-on-a-roll A to be cut off. The label dispensing machine 8 and the label curving cover 80 are disposed at one side of the film roll/bags-on-a-roll A on the reel B of the reel displacement unit 20 in the film-cutting position D4. The control unit (computer, microprocessor, control IC, etc.; not shown) is electrically coupled with the film roll/bags-on-a-roll making machine 1, the label curving cover driver 81, the cut-off device 91, the arched label feeding driver 95 and the movable device 98.

Referring to FIG. 7, the control unit controls the label curving cover driver 81 to move the label curving cover 80, causing the label curving cover 80 to cover the film roll/bags-on-a-roll A on the reel B, leaving a gap 807 between the arched inner wall 803 of the label curving cover 80 and the film roll/bags-on-a-roll A.

Figure 9:
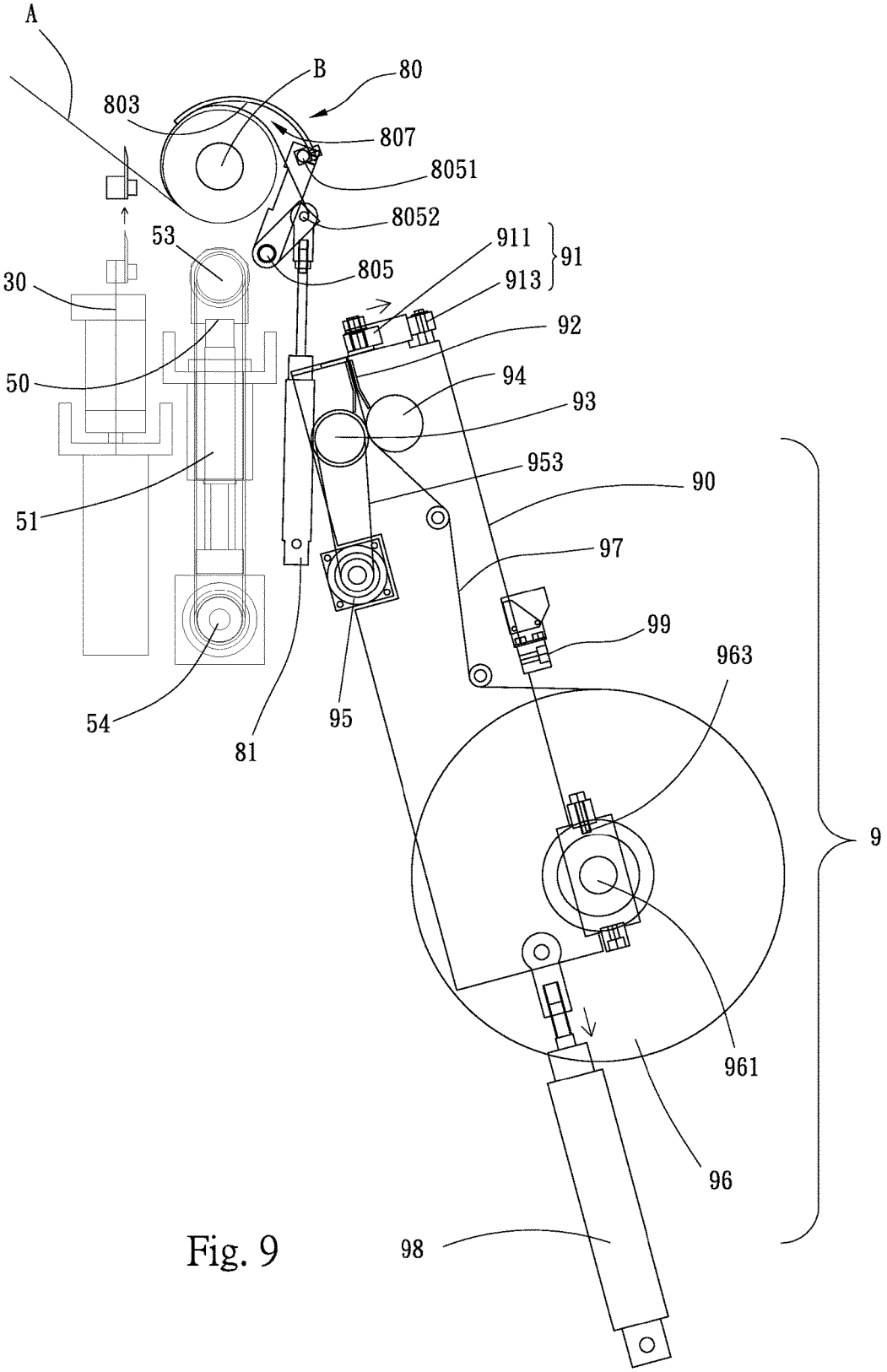
FIG. 9 is a schematic drawing of the present invention, illustrating the label dispensing machine disposed at one side relative to the reel and the cut-off mechanism operated.
Figure 10:
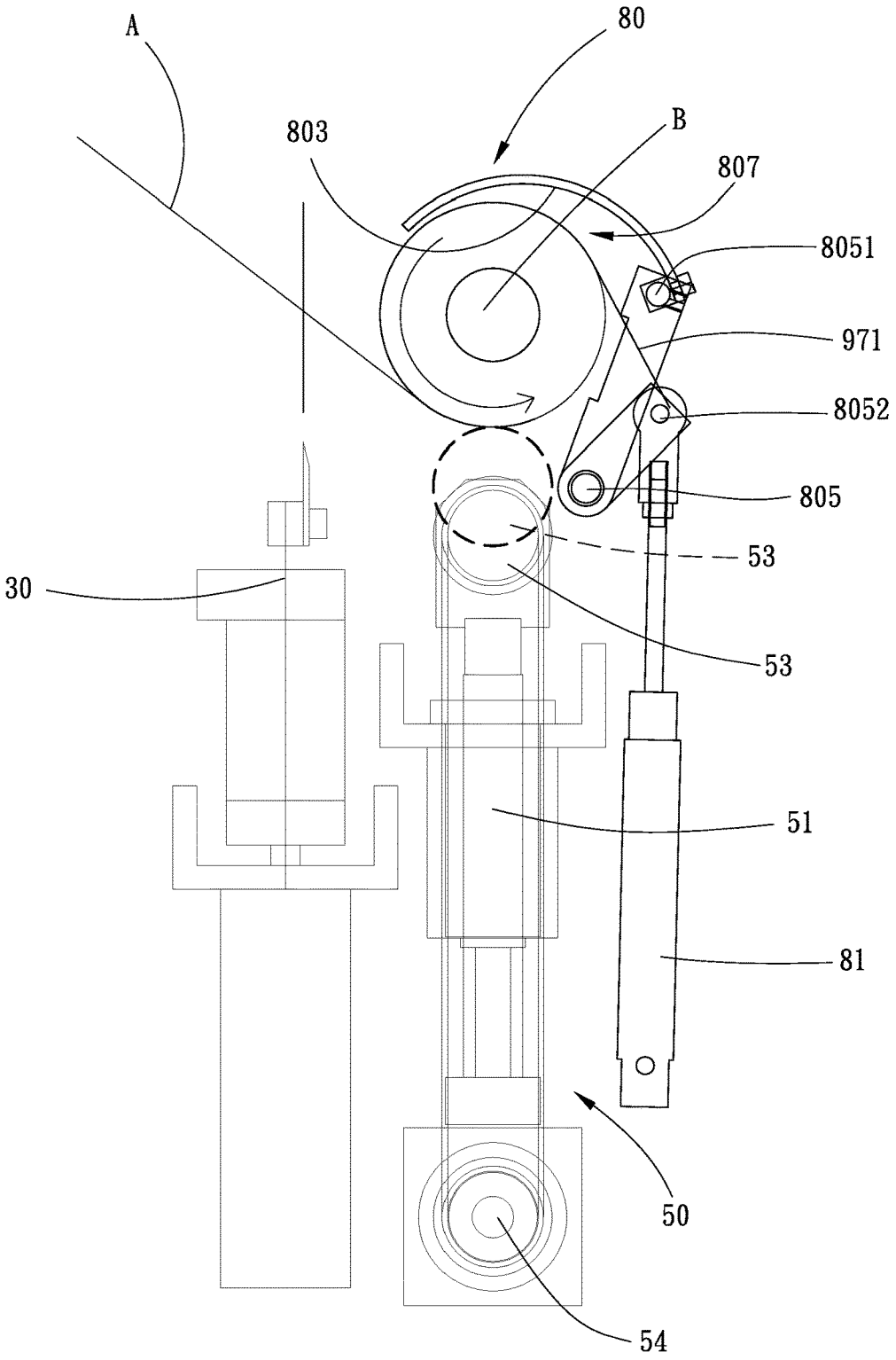
FIG. 10 corresponds to FIG. 7, illustrating the arch-shaped label of the label dispensing machine moved into the gap between the arched inner wall of the label curving cover and the film roll/bags-on-a-roll.

Referring also to FIGS. 8-10, the movable device 98 is operable to move the mount 90, cut-off device 91, guide unit 92, active wheel 93, passive wheel 94, arched label feeding driver 95 and feeding wheel 96 of the arched label output mechanism 9 toward the label curving cover 80, keeping the cut-off device 91 beneath the label curving cover 80. Thereafter, the control unit controls the arched label feeding driver 95 to rotate the active wheel 93 and then the passive wheel 94, causing the continuous series of label strip 97 to be delivered in between the active wheel 93 and the passive wheel 94 and guided by the guide unit 92 over one side of the cut-off device 91 so that the free end of the continuous series of label strip 97 can reach the gap 807 between the arched inner wall 803 of the label curving cover 80 and the film roll/bags-on-a-roll A where the free end of the continuous series of label strip 97 is forced by the arched inner wall 803 in the gap 807 into an arch-shaped to fit the arched surface of the film roll/bags-on-a-roll A of the reel B. At this time, the smoothening unit 50 is pressed on the film roll/bags-on-a-roll A of the reel B and rotated through a predetermined distance that is equal to the length of one individual arch-shaped label 971, thus, the free end of the continuous series of label strip 97 is smoothly arched and attached onto the suspended free end of the film roll/bags-on-a-roll A, enabling the free end of the continuous series of label strip 97 to be partially wrapped in the film roll/bags-on-a-roll A. At this time, the arched label feeding driver 95 is stopped.

Referring to FIGS. 1, 9 and 10, the control unit controls the cut-off device 91 to cut off the arch-shaped label 971 from the continuous series of label strip 97, at the same time, the film roll/bags-on-a-roll A on the reel B has reached the desired length (number of bags). The movable device 98 is moved to return the mount 90 to its previous position, carrying the cut-off device 91, guide unit 92, active wheel 93, passive wheel 94, arched label feeding driver 95 and feeding wheel 96 of the arched label output mechanism 9 away from the label curving cover 80. At the same time, the control unit controls the cut-off mechanism 30 of the film roll/bags-on-a-roll making machine 1 to cut off the film roll/bags-on-a-roll A (see FIG. 9).

Figure 11:
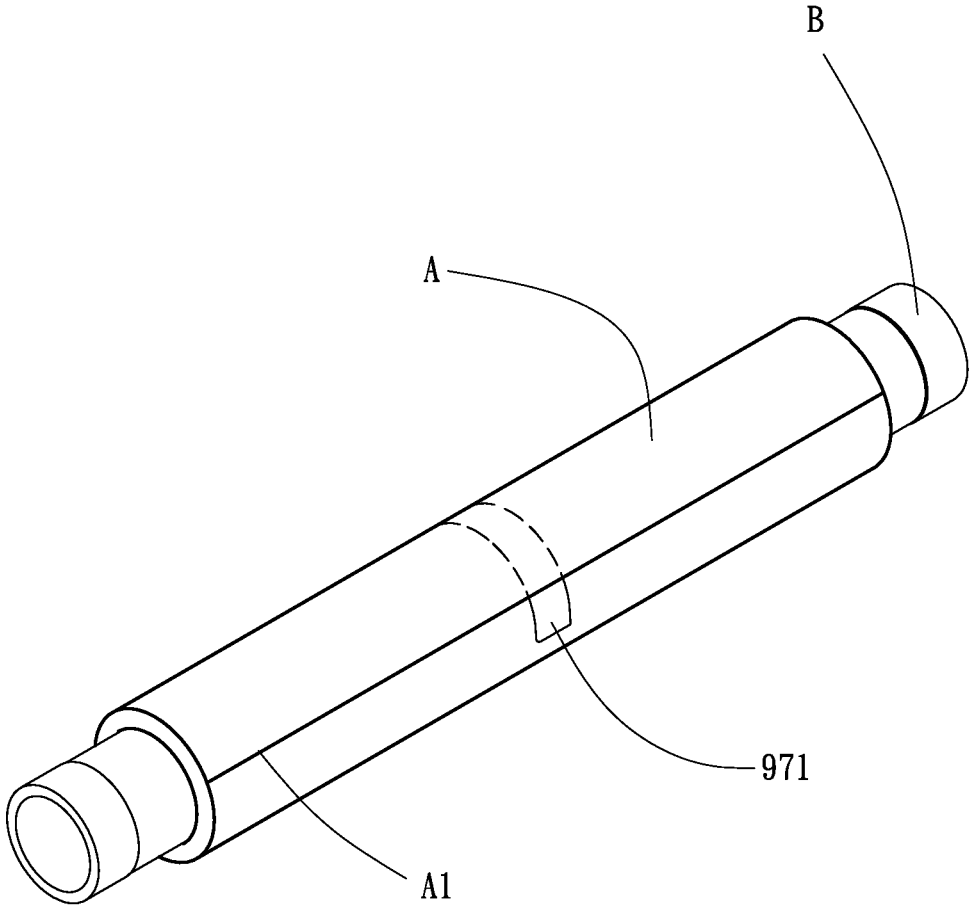
FIG. 11 is a perspective view illustrating the arch-shaped level wrapped adhered to a tear line of the film roll/bags-on-a-roll tear line.

Referring to FIGS. 10 and 11, after cutting, the free end of the film roll/bags-on-a-roll A terminates in a cut-off lead end A1. The control unit controls the smoothening unit 50 of the film roll/bags-on-a-roll making machine 1 to smoothen the cut-off lead end A1 of the film roll/bags-on-a-roll A and the arch-shaped label 971 that is wrapped in the film roll/bags-on-a-roll A. Subject to the material property of the film roll/bags-on-a-roll A, the arch-shaped label 971 is wrapped in the film roll/bags-on-a-roll A, leaving a short end portion of the arch-shaped label 971 outside the film roll/bags-on-a-roll A. This short end portion of the arch-shaped label 971 can easily found by an user and the user can then easily lift the cut-off lead end A1 of the film roll/bags-on-a-roll A.

Further, the arched label feeding driver 95 can be a motor, or preferably, a servo motor configured for rotating the active wheel 93 through a transmission belt (not shown), causing rotation of the passive wheel 94 to transfer the continuous series of label strip 97 for feeding. In the operation, the control unit controls the operation of the servo motor to feed the continuous series of label strip 97, or stop the feeding of the continuous series of label strip 97.

In the embodiment shown in FIG. 4 and FIG. 7, the label curving cover 80 further comprises a V-shaped swivel 805. The V-shaped swivel 805 defines a first free end 8051 and a second free end 8052. The first free end 8051 and the second free end 8052 define therebetween a contained angle. The label curving cover 80 has one end thereof perpendicularly connected to the first free end 8051, and an opposite end thereof movably connected to the second free end 8052. When the label curving cover driver 81 pushes the second free end 8052 of the V-shaped swivel 805 upward, the first free end 8051 forces the label curving cover 80 to turn upward (forward) and to further cover the film roll/bags-on-a-roll A on the reel B. On the contrary, when the label curving cover driver 81 pulls the second free end 8052 of the V-shaped swivel 805 downward, the first free end 8051 pulls the label curving cover 80 to turn downwardly (backwardly) away from the film roll/bags-on-a-roll A on the reel B. Further, the label curving cover driver 81 can be a pneumatic cylinder, hydraulic cylinder or lifter.

In the embodiment shown in FIG. 5 and FIG. 8, the cut-off device 91 comprises a cut-off knife 911 and a cut-off knife driver 913. The cut-off knife driver 913 is movably coupled with the cut-off knife 911. When the continuous series of label strip 97 reaches the gap 807 between the label curving cover 80 and the film roll/bags-on-a-roll A on the reel B, the control unit controls the cut-off knife driver 913 to move the cut-off knife 911, causing the cut-off knife 911 to cut off a predetermined length of the free end of the continuous series of label strip 97, thereby producing an arch-shaped label 971. Further, the cut-off knife driver 913 can be a pneumatic cylinder, hydraulic cylinder or lifter.

The invention achieves the effect of efficiently attaching the arch-shaped label 971 onto the cut-off lead end A1 of the film roll/bags-on-a-roll A on the reel B so that the user can easily and quickly find and lift the cut-off lead end A1 of the film roll/bags-on-a-roll A, eliminating the problem of being difficult to find and to lift the cut-off lead end of the thin and flexible film roll/bags-on-a-roll.

In the embodiment shown in FIG. 5 and FIG. 6, the guide unit 92 is a clip that defines therein a passing gap in a center area thereof. The continuous series of label strip 97 is moved through the passing gap of the clip and guided by the clip toward the inner side of the label curving cover 80.

In the embodiment shown in FIG. 1 and FIG. 5, the arched label output mechanism 9 comprises a sensor 99 electrically connected to the control unit (not shown). The sensor 99 is mounted at the mount near one side of the continuous series of label strip 97 that is fed by the feeding wheel 96. The sensor 99 is adapted for detecting the presence of the continuous series of label strip 97 and providing a corresponding signal to the control unit.

Referring to FIGS. 1 and 5 again, the feeding wheel 96 further comprises a wheel axle 961, and a tension device 963 adapted for rendering a pressure to the wheel axle 961, enabling the continuous series of label strip 97 to be positively delivered under a predetermined tension. The tension device 963 can be an elastic member, for example, spring fastened to the wheel axle 961, and an adjustment knob is provided for adjusting the pressure of the spring to the wheel axle 961 to keep the transfer of the continuous series of label strip 97 under a predetermined tension.

Referring to FIG. 5 again, the movable device 98 can be a pneumatic cylinder, hydraulic cylinder or lifter. Preferably, the movable device 98 is a pneumatic cylinder comprising a reciprocating rod 981. After fixation of the pneumatic cylinder, the free end of the reciprocating rod 981 is connected to the mount 90, and thus, the pneumatic cylinder is operable to move the mount 90, carrying the arched label output mechanism 9 toward or away from the label curving cover 80.

In the embodiment shown in FIG. 10, the smoothening unit 50 of the film roll/bags-on-a-roll making machine 1 is disposed adjacent to the film roll/bags-on-a-roll A in the reel displacement unit 20 in the film-cutting position D4. The smoothening unit 50 comprises a smoothening unit air pressure device set 51, a roller 53, and a smoothening unit power drive 54. The smoothening unit power drive 54 is coupled with the roller 53, and operable to move the roller 53 into contact with the film roll/bags-on-a-roll A and also to rotate roller 53, smoothening the film roll/bags-on-a-roll A and the attached arch-shaped label 971. The control unit controls the smoothening unit power drive 54 to rotate the roller 53 clockwise or counter-clockwise, smoothening and compacting the cut-off lead end A1 of the film roll/bags-on-a-roll A and the attached arch-shaped label 971.

Referring to FIG. 9, the cut-off mechanism 30 uses the air pressure device set 51 to lift a cutter in cutting off the film roll/bags-on-a-roll A. After cutting, the air pressure device set 51 is controlled to lower the cutter. With respect to the structure of the cut-off mechanism 30 and the structure of the smoothening unit 50, please refer to Taiwan Patent No. M504084 "film roll/bags-on-a-roll making machine" (equivalent to China Patent No. CN204588215U 號; U.S. Pat. No. 9,604,809).

When cutting off the film roll/bags-on-a-roll A, the smoothening unit air pressure device set 51 of the smoothening unit 50 is controlled to lift the roller 53 into contact with the film roll/bags-on-a-roll A, and then the smoothening unit power drive 54 of the smoothening unit 50 is controlled to rotate the roller 53 in smoothening the film roll/bags-on-a-roll A.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A label dispensing machine, comprising:

a label curving cover defining an arched inner wall;

a label curving cover driver coupled with said label curving cover and operable to bias said label curving cover;

an arched label output mechanism disposed at one side relative to said label curving cover, said arched label output mechanism comprising a mount, a cut-off device, a guide unit, an active wheel, a passive wheel, an arched label feeding driver, a feeding wheel, a continuous series of label strip and a movable device, said cut-off device being mounted at a top side of said mount, said guide unit is mounted at said mount below said cut-off device, said active wheel and said passive wheel being mounted at said mount below said guide unit and disposed in contact with each other, said arched label feeding driver being mounted at said mount and adapted for rotating said active wheel, said feeding wheel being rotatably mounted at an opposing bottom side of said mount, said continuous series of label strip being wound round said feeding wheel and having a lead end thereof inserted in between said active wheel and said passive wheel and guided by said guide unit over one side of said cut-off device, said movable device being connected with said mount and operable to move said mount; and a control unit electrically coupled with said label curving cover driver, said cut-off device, said arched label feeding driver and said movable device for controlling the operation of said label curving cover driver, said cut-off device, said arched label feeding driver and said movable device.

2. The label dispensing machine as claimed in claim 1, which is installed in a film roll/bags-on-a-roll making machine comprising a reel displacement unit, a cut-off mechanism and a smoothening unit, said reel displacement unit comprising a reel rolling up a film roll/bags-on-a-roll and a reel holding device configured to hold said reel and moving the reel properly through a reel let-off position, a reel-supplying position, a film-rolling position and a film-cutting position to dispense said film roll/bags-on-a-roll, the free end of said film roll/bags-on-a-roll being pulled out of said reel when said reel is moved from said film-rolling position to said film-cutting position and a predetermined length of the free end of said film roll/bags-on-a-roll being pulled out of said reel for allowing said film roll/bags-on-a-roll to be cut off when reached said film-cutting position, said label dispensing machine and said label curving cover being disposed at one side relative to said film roll/bags-on-a-roll on said reel of said reel displacement unit in said film-cutting position; said control unit is electrically coupled with said film roll/bags-on-a-roll making machine for controlling the operation of said film roll/bags-on-a-roll making machine.

3. The label dispensing machine as claimed in claim 1, wherein said control unit controls said label curving cover driver to move said label curving cover, causing said label curving cover to cover said film roll/bags-on-a-roll on said reel with a gap left between said arched inner wall of said label curving cover and said film roll/bags-on-a-roll; said movable device is controllable by said control unit to move said mount, said cut-off device, said guide unit, said active wheel, said passive wheel, said arched label feeding driver and said feeding wheel of said arched label output mechanism toward said label curving cover, keeping said cut-off device in proximity to a bottom side of said label curving cover.

4. The label dispensing machine as claimed in claim 1, wherein said label curving cover further comprises a V-shaped swivel, said V-shaped swivel comprising a first free end and a second free end, said first free end and said second free end defining therebetween a contained angle, said label curving cover having one end thereof perpendicularly connected to said first free end and an opposite end thereof movable coupled to said second free end.

5. The label dispensing machine as claimed in claim 1, wherein said cut-off device further comprises a cut-off knife, and a cut-off knife driver movable coupled with said cut-off knife and adapted for moving said cut-off knife.

6. The label dispensing machine as claimed in claim 1, wherein said guide unit 92 comprises a clip defining therein a passing gap in a center area thereof.

7. The label dispensing machine as claimed in claim 1, wherein said arched label feeding driver is selectively a motor or servomotor.

8. The label dispensing machine as claimed in claim 1, wherein said arched label output mechanism further comprises a sensor mounted at said mount near one side of said continuous series of label strip that is fed by said feeding wheel.

9. The label dispensing machine as claimed in claim 1, wherein said feeding wheel comprises a wheel axle, and a tension device adapted for rendering a pressure to said wheel axle.

10. The label dispensing machine as claimed in claim 1, wherein said movable device and said cut-off knife driver are respectively selectively a pneumatic cylinder, hydraulic cylinder or lifter.

* * * * *